US010204540B2

(12) United States Patent
Chaji

(10) Patent No.: US 10,204,540 B2
(45) Date of Patent: Feb. 12, 2019

(54) HIGH DENSITY PIXEL PATTERN

(71) Applicant: Ignis Innovation Inc., Waterloo (CA)

(72) Inventor: Gholamreza Chaji, Waterloo (CA)

(73) Assignee: Ignis Innovation inc., Waterloo, Ontario ( * ) Notice: Subject to any disclaimer, the term of this patent is extended or adjusted under 35 U.S.C. 154(b) by 0 days.

(21) Appl. No.: 15/333,734

(22) Filed: Oct. 25, 2016

(65) Prior Publication Data

US 2017/0116900 A1 Apr. 27, 2017

(30) Foreign Application Priority Data

Oct. 26, 2015 (CA) ..... 2909813

(51) Int. Cl.
*G09G 3/3233* (2016.01)
*G09G 3/20* (2006.01)

(52) U.S. Cl.
CPC ..... *G09G 3/2003* (2013.01); *G09G 3/3233* (2013.01); *G09G 2300/0452* (2013.01); *G09G 2340/0407* (2013.01)

(58) Field of Classification Search
CPC ..... G09G 3/2003; G09G 3/3233; G09G 2300/0452; G09G 2340/0407
See application file for complete search history.

(56) References Cited

U.S. PATENT DOCUMENTS 4,354,162 A 10/1982 Wright
4,758,831 A 7/1988 Kasahara et al.
4,963,860 A 10/1990 Stewart
4,975,691 A 12/1990 Lee
4,996,523 A 2/1991 Bell et al.
5,051,739 A 9/1991 Hayashida et al.
5,222,082 A 6/1993 Plus
5,266,515 A 11/1993 Robb et al.
5,498,880 A 3/1996 Lee et al.
5,589,847 A 12/1996 Lewis
5,619,033 A 4/1997 Weisfield
5,648,276 A 7/1997 Hara et al.
(Continued)

FOREIGN PATENT DOCUMENTS

CA 1294034 1/1992
CA 2109951 11/1992
(Continued)

OTHER PUBLICATIONS

Ahnood et al.: "Effect of threshold voltage instability on field effect mobility in thin film transistors deduced from constant current measurements"; dated Aug. 2009 (3 pages).
(Continued)

*Primary Examiner* — Ricardo L Osorio
(74) *Attorney, Agent, or Firm* — Stratford Managers Corporation

(57) ABSTRACT

A pixel pattern of material light emissive areas for an emissive display system having pixels, each pixel having subpixels, each subpixel having a light emitting device defining the material light emissive area of the subpixel, the pixel pattern comprising: for each pixel, a shared elongated subpixel of a first primary color shared with an adjacent pixel and an elongated subpixel of a second or third primary color located in an area on an opposite side of the shared elongated subpixel from the adjacent pixel.

17 Claims, 4 Drawing Sheets

(56) References Cited

U.S. PATENT DOCUMENTS 5,670,973 A 9/1997 Bassetti et al.
5,684,365 A 11/1997 Tang et al.
5,686,935 A 11/1997 Weisbrod
5,712,653 A 1/1998 Katoh et al.
5,714,968 A 2/1998 Ikeda
5,747,928 A 5/1998 Shanks et al.
5,748,160 A 5/1998 Shieh et al.
5,784,042 A 7/1998 Ono et al.
5,790,234 A 8/1998 Matsuyama
5,815,303 A 9/1998 Berlin
5,870,071 A 2/1999 Kawahata
5,874,803 A 2/1999 Garbuzov et al.
5,880,582 A 3/1999 Sawada
5,903,248 A 5/1999 Irwin
5,917,280 A 6/1999 Burrows et al.
5,923,794 A 7/1999 McGrath et al.
5,952,789 A 9/1999 Stewart et al.
5,990,629 A 11/1999 Yamada et al.
6,023,259 A 2/2000 Howard et al.
6,069,365 A 5/2000 Chow et al.
6,081,131 A 6/2000 Ishii
6,091,203 A 7/2000 Kawashima et al.
6,097,360 A 8/2000 Holloman
6,144,222 A 11/2000 Ho
6,157,583 A 12/2000 Starnes et al.
6,166,489 A 12/2000 Thompson et al.
6,177,915 B1 1/2001 Beeteson et al.
6,225,846 B1 5/2001 Wada et al.
6,229,508 B1 5/2001 Kane
6,232,939 B1 5/2001 Saito et al.
6,246,180 B1 6/2001 Nishigaki
6,252,248 B1 6/2001 Sano et al.
6,259,424 B1 7/2001 Kurogane
6,274,887 B1 8/2001 Yamazaki et al.
6,288,696 B1 9/2001 Holloman
6,300,928 B1 10/2001 Kim
6,303,963 B1 10/2001 Ohtani et al.
6,306,694 B1 10/2001 Yamazaki et al.
6,307,322 B1 10/2001 Dawson et al.
6,316,786 B1 11/2001 Mueller et al.
6,320,325 B1 11/2001 Cok et al.
6,323,631 B1 11/2001 Juang
6,323,832 B1 11/2001 Nishizawa et al.
6,345,085 B1 2/2002 Yeo et al.
6,348,835 B1 2/2002 Sato et al.
6,365,917 B1 4/2002 Yamazaki
6,373,453 B1 4/2002 Yudasaka
6,384,427 B1 5/2002 Yamazaki et al.
6,392,617 B1 5/2002 Gleason
6,399,988 B1 6/2002 Yamazaki
6,414,661 B1 7/2002 Shen et al.
6,420,758 B1 7/2002 Nakajima
6,420,834 B2 7/2002 Yamazaki et al.
6,420,988 B1 7/2002 Azami et al.
6,433,488 B1 8/2002 Bu
6,445,376 B2 9/2002 Parrish
6,468,638 B2 10/2002 Jacobsen et al.
6,489,952 B1 12/2002 Tanaka et al.
6,501,098 B2 12/2002 Yamazaki
6,501,466 B1 12/2002 Yamagashi et al.
6,512,271 B1 1/2003 Yamazaki et al.
6,518,594 B1 2/2003 Nakajima et al.
6,524,895 B2 2/2003 Yamazaki et al.
6,531,713 B1 3/2003 Yamazaki
6,559,594 B2 5/2003 Fukunaga et al.
6,573,195 B1 6/2003 Yamazaki et al.
6,573,584 B1 6/2003 Nagakari et al.
6,576,926 B1 6/2003 Yamazaki et al.
6,577,302 B2 6/2003 Hunter
6,580,408 B1 6/2003 Bae et al.
6,580,657 B2 6/2003 Sanford et al.
6,583,775 B1 6/2003 Sekiya et al.
6,583,776 B2 6/2003 Yamazaki et al.
6,587,086 B1 7/2003 Koyama
6,593,691 B2 7/2003 Nishi et al.
6,594,606 B2 7/2003 Everitt
6,597,203 B2 7/2003 Forbes
6,611,108 B2 8/2003 Kimura
6,617,644 B1 9/2003 Yamazaki et al.
6,618,030 B2 9/2003 Kane et al.
6,641,933 B1 11/2003 Yamazaki et al.
6,661,180 B2 12/2003 Koyama
6,661,397 B2 12/2003 Mikami et al.
6,670,637 B2 12/2003 Yamazaki et al.
6,677,713 B1 1/2004 Sung
6,680,577 B1 1/2004 Inukai et al.
6,687,266 B1 2/2004 Ma et al.
6,690,344 B1 2/2004 Takeuchi et al.
6,693,388 B2 2/2004 Oomura
6,693,610 B2 2/2004 Shannon et al.
6,697,057 B2 2/2004 Koyama et al.
6,720,942 B2 4/2004 Lee et al.
6,734,636 B2 5/2004 Sanford et al.
6,738,034 B2 5/2004 Kaneko et al.
6,738,035 B1 5/2004 Fan
6,771,028 B1 8/2004 Winters
6,777,712 B2 8/2004 Sanford et al.
6,780,687 B2 8/2004 Nakajima et al.
6,806,638 B2 10/2004 Lih et al.
6,806,857 B2 10/2004 Sempel et al.
6,809,706 B2 10/2004 Shimoda
6,859,193 B1 2/2005 Yumoto
6,861,670 B1 3/2005 Ohtani et al.
6,873,117 B2 3/2005 Ishizuka
6,873,320 B2 3/2005 Nakamura
6,878,968 B1 4/2005 Ohnuma
6,909,114 B1 6/2005 Yamazaki
6,909,419 B2 6/2005 Zavracky et al.
6,919,871 B2 7/2005 Kwon
6,937,215 B2 8/2005 Lo
6,940,214 B1 9/2005 Komiya et al.
6,943,500 B2 9/2005 LeChevalier
6,954,194 B2 10/2005 Matsumoto et al.
6,956,547 B2 10/2005 Bae et al.
6,995,510 B2 2/2006 Murakami et al.
6,995,519 B2 2/2006 Arnold et al.
7,022,556 B1 4/2006 Adachi
7,023,408 B2 4/2006 Chen et al.
7,027,015 B2 4/2006 Booth, Jr. et al.
7,034,793 B2 4/2006 Sekiya et al.
7,088,051 B1 8/2006 Cok
7,106,285 B2 9/2006 Naugler
7,116,058 B2 10/2006 Lo et al.
7,129,914 B2 10/2006 Knapp et al.
7,129,917 B2 10/2006 Yamazaki et al.
7,141,821 B1 11/2006 Yamazaki et al.
7,161,566 B2 1/2007 Cok et al.
7,193,589 B2 3/2007 Yoshida et al.
7,199,516 B2 4/2007 Seo et al.
7,220,997 B2 5/2007 Nakata
7,235,810 B1 6/2007 Yamazaki et al.
7,245,277 B2 7/2007 Ishizuka
7,248,236 B2 7/2007 Nathan et al.
7,264,979 B2 9/2007 Yamagata et al.
7,274,345 B2 9/2007 Imamura et al.
7,274,363 B2 9/2007 Ishizuka et al.
7,279,711 B1 10/2007 Yamazaki et al.
7,304,621 B2 12/2007 Oomori et al.
7,310,092 B2 12/2007 Imamura
7,315,295 B2 1/2008 Kimura
7,317,429 B2 1/2008 Shirasaki et al.
7,319,465 B2 1/2008 Mikami et al.
7,321,348 B2 1/2008 Cok et al.
7,339,636 B2 3/2008 Voloschenko et al.
7,355,574 B1 4/2008 Leon et al.
7,358,941 B2 4/2008 Ono et al.
7,402,467 B1 7/2008 Kadono et al.
7,414,600 B2 8/2008 Nathan et al.
7,432,885 B2 10/2008 Asano et al.
7,474,285 B2 1/2009 Kimura
7,485,478 B2 2/2009 Yamagata et al.
7,502,000 B2 3/2009 Yuki et al.
7,535,449 B2 5/2009 Miyazawa
7,554,512 B2 6/2009 Steer

(56) References Cited

U.S. PATENT DOCUMENTS 7,569,849 B2 8/2009 Nathan et al.
7,619,594 B2 11/2009 Hu
7,619,597 B2 11/2009 Nathan et al.
7,697,052 B1 4/2010 Yamazaki et al.
7,825,419 B2 11/2010 Yamagata et al.
7,859,492 B2 12/2010 Kohno
7,868,859 B2 1/2011 Tomida et al.
7,876,294 B2 1/2011 Sasaki et al.
7,948,170 B2 5/2011 Striakhilev et al.
7,969,390 B2 6/2011 Yoshida
7,995,010 B2 8/2011 Yamazaki et al.
8,044,893 B2 10/2011 Nathan et al.
8,115,707 B2 2/2012 Nathan et al.
8,378,362 B2 2/2013 Heo et al.
8,493,295 B2 7/2013 Yamazaki et al.
8,497,525 B2 7/2013 Yamagata et al.
8,552,635 B2 * 10/2013 Kim ..... G09G 3/2003 313/504
9,262,957 B2 * 2/2016 Yang ..... G09G 3/2003
9,318,537 B2 * 4/2016 Sung ..... H01L 27/3211
9,324,769 B2 * 4/2016 Guo ..... G09G 3/20
9,472,146 B2 * 10/2016 Yang ..... G09G 3/3648
9,478,586 B2 * 10/2016 Lee ..... G09G 3/3233
9,837,473 B2 * 12/2017 Kim ..... H01L 27/3216
9,858,847 B2 * 1/2018 Matsueda ..... G09G 3/2003
9,904,122 B2 * 2/2018 Okita ..... G02F 1/134309
9,959,808 B2 * 5/2018 Sun ..... G09G 3/3225
2001/0002703 A1 6/2001 Koyama
2001/0004190 A1 6/2001 Nishi et al.
2001/0013806 A1 8/2001 Notani
2001/0015653 A1 8/2001 De Jong et al.
2001/0020926 A1 9/2001 Kujik
2001/0024186 A1 9/2001 Kane
2001/0026127 A1 10/2001 Yoneda et al.
2001/0026179 A1 10/2001 Saeki
2001/0026257 A1 10/2001 Kimura
2001/0030323 A1 10/2001 Ikeda
2001/0033199 A1 10/2001 Aoki
2001/0038098 A1 11/2001 Yamazaki et al.
2001/0043173 A1 11/2001 Troutman
2001/0045929 A1 11/2001 Prache et al.
2001/0052606 A1 12/2001 Sempel et al.
2001/0052898 A1 12/2001 Osame et al.
2002/0000576 A1 1/2002 Inukai
2002/0011796 A1 1/2002 Koyama
2002/0011799 A1 1/2002 Kimura
2002/0011981 A1 1/2002 Kujik
2002/0015031 A1 2/2002 Fujita et al.
2002/0015032 A1 2/2002 Koyama et al.
2002/0030528 A1 3/2002 Matsumoto et al.
2002/0030647 A1 3/2002 Hack et al.
2002/0036463 A1 3/2002 Yoneda et al.
2002/0047852 A1 4/2002 Inukai et al.
2002/0048829 A1 4/2002 Yamazaki et al.
2002/0050795 A1 5/2002 Imura
2002/0053401 A1 5/2002 Ishikawa et al.
2002/0070909 A1 6/2002 Asano et al.
2002/0080108 A1 6/2002 Wang
2002/0084463 A1 7/2002 Sanford et al.
2002/0101172 A1 8/2002 Bu
2002/0101433 A1 8/2002 McKnight
2002/0113248 A1 8/2002 Yamagata et al.
2002/0122308 A1 9/2002 Ikeda
2002/0130686 A1 9/2002 Forbes
2002/0154084 A1 10/2002 Tanaka et al.
2002/0158823 A1 10/2002 Zavracky et al.
2002/0163314 A1 11/2002 Yamazaki et al.
2002/0167471 A1 11/2002 Everitt
2002/0180369 A1 12/2002 Koyama
2002/0180721 A1 12/2002 Kimura et al.
2002/0186214 A1 12/2002 Siwinski
2002/0190332 A1 12/2002 Lee et al.
2002/0190924 A1 12/2002 Asano et al.
2002/0190971 A1 12/2002 Nakamura et al.
2002/0195967 A1 12/2002 Kim et al.
2002/0195968 A1 12/2002 Sanford et al.
2003/0020413 A1 1/2003 Oomura
2003/0030603 A1 2/2003 Shimoda
2003/0062524 A1 4/2003 Kimura
2003/0063081 A1 4/2003 Kimura et al.
2003/0071804 A1 4/2003 Yamazaki et al.
2003/0071821 A1 4/2003 Sundahl
2003/0076048 A1 4/2003 Rutherford
2003/0090445 A1 5/2003 Chen et al.
2003/0090447 A1 5/2003 Kimura
2003/0090481 A1 5/2003 Kimura
2003/0095087 A1 5/2003 Libsch
2003/0107560 A1 6/2003 Yumoto et al.
2003/0111966 A1 6/2003 Mikami et al.
2003/0122745 A1 7/2003 Miyazawa
2003/0140958 A1 7/2003 Yang et al.
2003/0151569 A1 8/2003 Lee et al.
2003/0169219 A1 9/2003 LeChevalier
2003/0174152 A1 9/2003 Noguchi
2003/0178617 A1 9/2003 Appenzeller et al.
2003/0179626 A1 9/2003 Sanford et al.
2003/0197663 A1 10/2003 Lee et al.
2003/0206060 A1 11/2003 Suzuki
2003/0230980 A1 12/2003 Forrest et al.
2004/0027063 A1 2/2004 Nishikawa
2004/0056604 A1 3/2004 Shih et al.
2004/0066357 A1 4/2004 Kawasaki
2004/0070557 A1 4/2004 Asano et al.
2004/0080262 A1 4/2004 Park et al.
2004/0080470 A1 4/2004 Yamazaki et al.
2004/0090400 A1 5/2004 Yoo
2004/0108518 A1 6/2004 Jo
2004/0113903 A1 6/2004 Mikami et al.
2004/0129933 A1 7/2004 Nathan et al.
2004/0130516 A1 7/2004 Nathan et al.
2004/0135749 A1 7/2004 Kondakov et al.
2004/0145547 A1 7/2004 Oh
2004/0150592 A1 8/2004 Mizukoshi et al.
2004/0150594 A1 8/2004 Koyama et al.
2004/0150595 A1 8/2004 Kasai
2004/0155841 A1 8/2004 Kasai
2004/0174347 A1 9/2004 Sun et al.
2004/0174349 A1 9/2004 Libsch
2004/0183759 A1 9/2004 Stevenson et al.
2004/0189627 A1 9/2004 Shirasaki et al.
2004/0196275 A1 10/2004 Hattori
2004/0201554 A1 10/2004 Satoh
2004/0207615 A1 10/2004 Yumoto
2004/0233125 A1 11/2004 Tanghe et al.
2004/0239596 A1 12/2004 Ono et al.
2004/0252089 A1 12/2004 Ono et al.
2004/0257355 A1 12/2004 Naugler
2004/0263437 A1 12/2004 Hattori
2005/0007357 A1 1/2005 Yamashita et al.
2005/0030267 A1 2/2005 Tanghe et al.
2005/0035709 A1 2/2005 Furuie et al.
2005/0067970 A1 3/2005 Libsch et al.
2005/0067971 A1 3/2005 Kane
2005/0068270 A1 3/2005 Awakura
2005/0088085 A1 4/2005 Nishikawa et al.
2005/0088103 A1 4/2005 Kageyama et al.
2005/0110420 A1 5/2005 Arnold et al.
2005/0117096 A1 6/2005 Voloschenko et al.
2005/0140598 A1 6/2005 Kim et al.
2005/0140610 A1 6/2005 Smith et al.
2005/0145891 A1 7/2005 Abe
2005/0156831 A1 7/2005 Yamazaki et al.
2005/0168416 A1 8/2005 Hashimoto et al.
2005/0206590 A1 9/2005 Sasaki et al.
2005/0225686 A1 10/2005 Brummack et al.
2005/0260777 A1 11/2005 Brabec et al.
2005/0269959 A1 12/2005 Uchino et al.
2005/0269960 A1 12/2005 Ono et al.
2005/0285822 A1 12/2005 Reddy et al.
2005/0285825 A1 12/2005 Eom et al.
2006/0007072 A1 1/2006 Choi et al.
2006/0012310 A1 1/2006 Chen et al.
2006/0027807 A1 2/2006 Nathan et al.
2006/0030084 A1 2/2006 Young

(56) References Cited

U.S. PATENT DOCUMENTS

2006/0038758 A1 2/2006 Routley et al.
2006/0044227 A1 3/2006 Hadcock
2006/0066527 A1 3/2006 Chou
2006/0092185 A1 5/2006 Jo et al.
2006/0232522 A1 10/2006 Roy et al.
2006/0261841 A1 11/2006 Fish
2006/0264143 A1 11/2006 Lee et al.
2006/0273997 A1 12/2006 Nathan et al.
2006/0284801 A1 12/2006 Yoon et al.
2007/0001937 A1 1/2007 Park et al.
2007/0001939 A1 1/2007 Hashimoto et al.
2007/0008268 A1 1/2007 Park et al.
2007/0008297 A1 1/2007 Bassetti
2007/0046195 A1 3/2007 Chin et al.
2007/0069998 A1 3/2007 Naugler et al.
2007/0080905 A1 4/2007 Takahara
2007/0080906 A1 4/2007 Tanabe
2007/0080908 A1 4/2007 Nathan et al.
2007/0080918 A1 4/2007 Kawachi et al.
2007/0103419 A1 5/2007 Uchino et al.
2007/0182671 A1 8/2007 Nathan et al.
2007/0273294 A1 11/2007 Nagayama
2007/0285359 A1 12/2007 Ono
2007/0296672 A1 12/2007 Kim et al.
2008/0042948 A1 2/2008 Yamashita et al.
2008/0055209 A1 3/2008 Cok
2008/0074413 A1 3/2008 Ogura
2008/0088549 A1 4/2008 Nathan et al.
2008/0122803 A1 5/2008 Izadi et al.
2008/0230118 A1 9/2008 Nakatani et al.
2009/0032807 A1 2/2009 Shinohara et al.
2009/0051283 A1 2/2009 Cok et al.
2009/0121983 A1* 5/2009 Sung ..... H01L 27/3216 345/76
2009/0160743 A1 6/2009 Tomida et al.
2009/0162961 A1 6/2009 Deane
2009/0174628 A1 7/2009 Wang et al.
2009/0213046 A1 8/2009 Nam
2009/0322215 A1* 12/2009 Sung ..... H01L 27/3211 313/504
2010/0052524 A1 3/2010 Kinoshita
2010/0078230 A1 4/2010 Rosenblatt et al.
2010/0079711 A1 4/2010 Tanaka
2010/0097335 A1 4/2010 Jung et al.
2010/0133994 A1 6/2010 Song et al.
2010/0134456 A1 6/2010 Oyamada
2010/0140600 A1 6/2010 Clough et al.
2010/0156279 A1 6/2010 Tamura et al.
2010/0237374 A1 9/2010 Chu et al.
2010/0328294 A1 12/2010 Sasaki et al.
2011/0090210 A1 4/2011 Sasaki et al.
2011/0133636 A1 6/2011 Matsuo et al.
2011/0180825 A1 7/2011 Lee et al.
2011/0260951 A1* 10/2011 Hwang ..... G02F 1/134336 345/55
2012/0049726 A1* 3/2012 Yoo ..... H01L 27/3213 313/504
2012/0212468 A1 8/2012 Govil
2013/0009930 A1 1/2013 Cho et al.
2013/0032831 A1 2/2013 Chaji et al.
2013/0113785 A1 5/2013 Sumi
2013/0249976 A1* 9/2013 Kunieda ..... G09G 3/003 345/698
2014/0246654 A1* 9/2014 Huang ..... H01L 27/326 257/40
2015/0061978 A1* 3/2015 Shih ..... G09G 3/3225 345/76
2015/0155346 A1* 6/2015 Motoyama ..... H01L 51/5265 257/89
2015/0270317 A1* 9/2015 Lee ..... H01L 27/3218 257/40
2015/0379916 A1* 12/2015 Guo ..... G02F 1/136286 345/694
2015/0379924 A1* 12/2015 Matsueda ..... G09G 3/3208 345/690
2016/0027369 A1* 1/2016 Guo ..... G09G 3/2003 345/694
2016/0126296 A1* 5/2016 Feng ..... H01L 27/3218 257/40
2017/0104045 A1* 4/2017 Hanamura ..... H01L 51/5265
2017/0139264 A1* 5/2017 Fu ..... G02F 1/133512
2017/0309688 A1* 10/2017 Lee ..... G09G 3/3225

FOREIGN PATENT DOCUMENTS

CA 2 249 592 7/1998
CA 2 368 386 9/1999
CA 2 242 720 1/2000
CA 2 354 018 6/2000
CA 2 436 451 8/2002
CA 2 438 577 8/2002
CA 2 483 645 12/2003
CA 2 463 653 1/2004
CA 2498136 3/2004
CA 2522396 11/2004
CA 2443206 3/2005
CA 2472671 12/2005
CA 2567076 1/2006
CA 2526782 4/2006
CN 1381032 11/2002
CN 1448908 10/2003
CN 1776922 5/2006
DE 20 2006 005427 6/2006
EP 0 940 796 9/1999
EP 1 028 471 A 8/2000
EP 1 103 947 5/2001
EP 1 130 565 A1 9/2001
EP 1 184 833 3/2002
EP 1 194 013 4/2002
EP 1 310 939 5/2003
EP 1 335 430 A1 8/2003
EP 1 372 136 12/2003
EP 1 381 019 1/2004
EP 1 418 566 5/2004
EP 1 429 312 A 6/2004
EP 1 439 520 7/2004
EP 1 465 143 A 10/2004
EP 1 467 408 10/2004
EP 1 517 290 3/2005
EP 1 521 203 A2 4/2005
EP 2317499 5/2011
GB 2 205 431 12/1988
JP 09 090405 4/1997
JP 10-153759 6/1998
JP 10-254410 9/1998
JP 11 231805 8/1999
JP 11-282419 10/1999
JP 2000/056847 2/2000
JP 2000-077192 3/2000
JP 2000-089198 3/2000
JP 2000-352941 12/2000
JP 2002-91376 3/2002
JP 2002-268576 9/2002
JP 2002-278513 9/2002
JP 2002-333862 11/2002
JP 2003-022035 1/2003
JP 2003-076331 3/2003
JP 2003-150082 5/2003
JP 2003-177709 6/2003
JP 2003-271095 9/2003
JP 2003-308046 10/2003
JP 2005-057217 3/2005
JP 2006065148 3/2006
JP 2009282158 12/2009
TW 485337 5/2002
TW 502233 9/2002
TW 538650 6/2003
TW 569173 1/2004
WO WO 94/25954 11/1994
WO WO 99/48079 9/1999
WO WO 01/27910 A1 4/2001
WO WO 02/067327 A 8/2002

(56) References Cited

FOREIGN PATENT DOCUMENTS

| | | | |
|---|---|---|---|
| WO | WO 03/034389 | A | 4/2003 |
| WO | WO 03/063124 | | 7/2003 |
| WO | WO 03/077231 | | 9/2003 |
| WO | WO 03/105117 | | 12/2003 |
| WO | WO 2004/003877 | | 1/2004 |
| WO | WO 2004/034364 | | 4/2004 |
| WO | WO 2005/022498 | | 3/2005 |
| WO | WO 2005/029455 | | 3/2005 |
| WO | WO 2005/055185 | | 6/2005 |
| WO | WO 2006/053424 | | 5/2006 |
| WO | WO 2006/063448 | A | 6/2006 |
| WO | WO 2006/137337 | | 12/2006 |
| WO | WO 2007/003877 | A | 1/2007 |
| WO | WO 2007/079572 | | 7/2007 |
| WO | WO 2010/023270 | | 3/2010 |

OTHER PUBLICATIONS

Alexander et al.: "Pixel circuits and drive schemes for glass and elastic AMOLED displays"; dated Jul. 2005 (9 pages).
Alexander et al.: "Unique Electrical Measurement Technology for Compensation, Inspection, and Process Diagnostics of AMOLED HDTV"; dated May 2010 (4 pages).
Ashtiani et al.: "AMOLED Pixel Circuit With Electronic Compensation of Luminance Degradation"; dated Mar. 2007 (4 pages).
Chaji et al.: "A Current-Mode Comparator for Digital Calibration of Amorphous Silicon AMOLED Displays"; dated Jul. 2008 (5 pages).
Chaji et al.: "A fast settling current driver based on the CCII for AMOLED displays"; dated Dec. 2009 (6 pages).
Chaji et al.: "A Low-Cost Stable Amorphous Silicon AMOLED Display with Full V~T- and V~O~L~E~D Shift Compensation"; dated May 2007 (4 pages).
Chaji et al.: "A low-power driving scheme for a-Si:H active-matrix organic light-emitting diode displays"; dated Jun. 2005 (4 pages).
Chaji et al.: "A low-power high-performance digital circuit for deep submicron technologies"; dated Jun. 2005 (4 pages).
Chaji et al.: "A novel a-Si:H AMOLED pixel circuit based on short-term stress stability of a-Si:H TFTs"; dated Oct. 2005 (3 pages).
Chaji et al.: "A Novel Driving Scheme and Pixel Circuit for AMOLED Displays"; dated Jun. 2006 (4 pages).
Chaji et al.: "A novel driving scheme for high-resolution large-area a-Si:H AMOLED displays"; dated Aug. 2005 (4 pages).
Chaji et al.: "A Stable Voltage-Programmed Pixel Circuit for a-Si:H AMOLED Displays"; dated Dec. 2006 (12 pages).
Chaji et al.: "A Sub-μA fast-settling current-programmed pixel circuit for AMOLED displays"; dated Sep. 2007.
Chaji et al.: "An Enhanced and Simplified Optical Feedback Pixel Circuit for AMOLED Displays"; dated Oct. 2006.
Chaji et al.: "Compensation technique for DC and transient instability of thin film transistor circuits for large-area devices"; dated Aug. 2008.
Chaji et al.: "Driving scheme for stable operation of 2-TFT a-Si AMOLED pixel"; dated Apr. 2005 (2 pages).
Chaji et al.: "Dynamic-effect compensating technique for stable a-Si:H AMOLED displays"; dated Aug. 2005 (4 pages).
Chaji et al.: "Electrical Compensation of OLED Luminance Degradation"; dated Dec. 2007 (3 pages).
Chaji et al.: "eUTDSP: a design study of a new VLIW-based DSP architecture"; dated May 2003 (4 pages).
Chaji et al.: "Fast and Offset-Leakage Insensitive Current-Mode Line Driver for Active Matrix Displays and Sensors"; dated Feb. 2009 (8 pages).
Chaji et al.: "High Speed Low Power Adder Design With a New Logic Style: Pseudo Dynamic Logic (SDL)"; dated Oct. 2001 (4 pages).
Chaji et al.: "High-precision, fast current source for large-area current-programmed a-Si flat panels"; dated Sep. 2006 (4 pages).
Chaji et al.: "Low-Cost AMOLED Television with IGNIS Compensating Technology"; dated May 2008 (4 pages).
Chaji et al.: "Low-Cost Stable a-Si:H AMOLED Display for Portable Applications"; dated Jun. 2006 (4 pages).
Chaji et al.: "Low-Power Low-Cost Voltage-Programmed a-Si:H AMOLED Display"; dated Jun. 2008 (5 pages).
Chaji et al.: "Merged phototransistor pixel with enhanced near infrared response and flicker noise reduction for biomolecular imaging"; dated Nov. 2008 (3 pages).
Chaji et al.: "Parallel Addressing Scheme for Voltage-Programmed Active-Matrix OLED Displays"; dated May 2007 (6 pages).
Chaji et al.: "Pseudo dynamic logic (SDL): a high-speed and low-power dynamic logic family"; dated 2002 (4 pages).
Chaji et al.: "Stable a-Si:H circuits based on short-term stress stability of amorphous silicon thin film transistors"; dated May 2006 (4 pages).
Chaji et al.: "Stable Pixel Circuit for Small-Area High-Resolution a-Si:H AMOLED Displays"; dated Oct. 2008 (6 pages).
Chaji et al.: "Stable RGBW AMOLED display with OLED degradation compensation using electrical feedback"; dated Feb. 2010 (2 pages).
Chaji et al.: "Thin-Film Transistor Integration for Biomedical Imaging and AMOLED Displays"; dated 2008 (177 pages).
European Search Report and Written Opinion for Application No. 08 86 5338 dated Nov. 2, 2011 (7 pages).
European Search Report for European Application No. EP 04 78 6661 dated Mar. 9, 2009.
European Search Report for European Application No. EP 05 75 9141 dated Oct. 30, 2009.
European Search Report for European Application No. EP 05 82 1114 dated Mar. 27, 2009 (2 pages).
European Search Report for European Application No. EP 07 71 9579 dated May 20, 2009.
European Search Report dated Mar. 26, 2012 in corresponding European Patent Application No. 10000421.7 (6 pages).
Extended European Search Report dated Apr. 27, 2011 issued during prosecution of European patent application No. 09733076.5 (13 pages).
Goh et al., "A New a-Si:H Thin Film Transistor Pixel Circul for Active-Matrix Organic Light-Emitting Diodes", IEEE Electron Device Letters, vol. 24, No. 9, Sep. 2003, 4 pages.
International Search Report for International Application No. PCT/CA02/00180 dated Jul. 31, 2002 (3 pages).
International Search Report for International Application No. PCT/CA2004/001741 dated Feb. 21, 2005.
International Search Report for International Application No. PCT/CA2005/001844 dated Mar. 28, 2006 (2 pages).
International Search Report for International Application No. PCT/CA2005/001007 dated Oct. 18, 2005.
International Search Report for International Application No. PCT/CA2007/000652 dated Jul. 25, 2007.
International Search Report for International Application No. PCT/CA2008/002307, dated Apr. 28, 2009 (3 pages).
International Search Report for International Application No. PCT/IB2011/055135, Canadian Patent Office, dated Apr. 16, 2012 (5 pages).
International Search Report dated Jul. 30, 2009 for International Application No. PCT/CA2009/000501 (4 pages).
Jafarabadiashtiani et al.: "A New Driving Method for a-Si AMOLED Displays Based on Voltage Feedback"; dated 2005 (4 pages).
Lee et al.: "Ambipolar Thin-Film Transistors Fabricated by PECVD Nanocrystalline Silicon"; dated 2006 (6 pages).
Ma e y et al: "Organic Light-Emitting Diode/Thin Film Transistor Integration for foldable Displays" Conference record of the 1997 International display research conference and international workshops on LCD technology and emissive technology. Toronto, Sep. 15-19, 1997 (6 pages).
Matsueda y et al.: "35.1: 2.5-in. AMOLED with Integrated 6-bit Gamma Compensated Digital Data Driver"; dated May 2004.
Nathan et al.: "Backplane Requirements for Active Matrix Organic Light Emitting Diode Displays"; dated 2006 (16 pages).

(56) References Cited

OTHER PUBLICATIONS

Nathan et al.: "Call for papers second international workshop on compact thin-film transistor (TFT) modeling for circuit simulation"; dated Sep. 2009 (1 page).
Nathan et al.: "Driving schemes for a-Si and LTPS AMOLED displays"; dated Dec. 2005 (11 pages).
Nathan et al.: "Invited Paper: a -Si for AMOLED—Meeting the Performance and Cost Demands of Display Applications (Cell Phone to HDTV)"; dated 2006 (4 pages).
Nathan et al.: "Thin film imaging technology on glass and plastic" ICM 2000, Proceedings of the 12th International Conference on Microelectronics, (IEEE Cat. No. 00EX453), Tehran Iran; dated Oct. 31-Nov. 2, 2000, pp. 11-14, ISBN: 964-360-057-2, p. 13, col. 1, line 11-48; (4 pages).
Nathan et al., "Amorphous Silicon Thin Film Transistor Circuit Integration for Organic LED Displays on Glass and Plastic", IEEE Journal of Solid-State Circuits, vol. 39, No. 9, Sep. 2004, pp. 1477-1486.
Office Action issued in Chinese Patent Application 200910246264.4 dated Jul. 5, 2013; 8 pages.
Patent Abstracts of Japan, vol. 2000, No. 09, Oct. 13, 2000—JP 2000 172199 A, Jun. 3, 2000, abstract.
Patent Abstracts of Japan, vol. 2002, No. 03, Apr. 3, 2002 (Apr. 4, 2004 & JP 2001 318627 A (Semiconductor EnergyLab DO LTD), Nov. 16, 2001, abstract, paragraphs '01331-01801, paragraph '01691, paragraph '01701, paragraph '01721 and figure 10.
Philipp: "Charge transfer sensing" Sensor Review, vol. 19, No. 2, Dec. 31, 1999 (Dec. 31, 1999), 10 pages.
Rafati et al.: "Comparison of a 17 b multiplier in Dual-rail domino and in Dual-rail D L (D L) logic styles"; dated 2002 (4 pages).
Safavaian et al.: "Three-TFT image sensor for real-time digital X-ray imaging"; dated Feb. 2, 2006 (2 pages).
Safavian et al.: "3-TFT active pixel sensor with correlated double sampling readout circuit for real-time medical x-ray imaging"; dated Jun. 2006 (4 pages).
Safavian et al.: "A novel current scaling active pixel sensor with correlated double sampling readout circuit for real time medical x-ray imaging"; dated May 2007 (7 pages).
Safavian et al.: "A novel hybrid active-passive pixel with correlated double sampling CMOS readout circuit for medical x-ray imaging"; dated May 2008 (4 pages).
Safavian et al.: "Self-compensated a-Si:H detector with current-mode readout circuit for digital X-ray fluoroscopy"; dated Aug. 2005 (4 pages).
Safavian et al.: "TFT active image sensor with current-mode readout circuit for digital x-ray fluoroscopy [5969D-82]"; dated Sep. 2005 (9 pages).
Sanford, James L., et al., "4.2 TFT AMOLED Pixel Circuits and Driving Methods", SID 03 Digest, ISSN/0003, 2003, pp. 10-13.
Stewart M. et al., "Polysilicon TFT technology for active matrix OLED displays" IEEE transactions on electron devices, vol. 48, No. 5; Dated May, 2001 (7 pages).
Tatsuya Sasaoka et al., 24.4L; Late-News Paper: A 13.0-inch AM-OLED Display with Top Emitting Structure and Adaptive Current Mode Programmed Pixel Circuit (TAC), SID 01 Digest, (2001), pp. 384-387.
Vygranenko et al.: "Stability of indium-oxide thin-film transistors by reactive ion beam assisted deposition"; dated 2009.
Wang et al.: "Indium oxides by reactive ion beam assisted evaporation: From material study to device application"; dated Mar. 2009 (6 pages).
Written Opinion dated Jul. 30, 2009 for International Application No. PCT/CA2009/000501 (6 pages).
Yi He et al., "Current-Source a-Si:H Thin Film Transistor Circuit for Active-Matrix Organic Light-Emitting Displays", IEEE Electron Device Letters, vol. 21, No. 12, Dec. 2000, pp. 590-592.
Zhiguo Meng et al; "24.3: Active-Matrix Organic Light-Emitting Diode Display implemented Using Metal-Induced Unilaterally Crystallized Polycrystalline Silicon Thin-Film Transistors", SID 01Digest, (2001), pp. 380-383.
International Search Report for Application No. PCT/IB2014/059409, Canadian Intellectual Property Office, dated Jun. 12, 2014 (4 pages).
Written Opinion for Application No. PCT/IB2014/059409, Canadian Intellectual Property Office, dated Jun. 12, 2014 (5 pages).
Extended European Search Report for Application No. EP 14181848.4, dated Mar. 5, 2015, (9 pages).

* cited by examiner

HIGH DENSITY PIXEL PATTERN

PRIORITY CLAIM

This application claims priority to Canadian Application No. 2,909,813, filed Oct. 26, 2015, which is hereby incorporated by reference herein in its entirety.

FIELD OF THE INVENTION

The present disclosure relates to pixel patterns for light emissive visual display technology, and particularly to pixel patterns for high pixel per inch (PPI) display in an active matrix light emitting diode device (AMOLED) and other emissive displays.

BRIEF SUMMARY

According to one aspect, there is provided a pixel pattern of material light emissive areas for an emissive display system having pixels, each pixel having subpixels, each subpixel having a light emitting device defining the material light emissive area of the subpixel, the pixel pattern comprising: for each pixel, a shared elongated subpixel of a first primary color shared with an adjacent pixel and an elongated subpixel of a second or third primary color located in an area on an opposite side of the shared elongated subpixel from the adjacent pixel.

In some embodiments, the shared elongated subpixel has a length greater than half of a length or width of a pixel. In some embodiments, the shared elongated subpixel has a length extending substantially to the length or width of the pixel.

In some embodiments, the pixel pattern further comprises, for each pixel, at least one further subpixel of a the third or second primary color different from the second or third primary color of the elongated subpixel.

In some embodiments, the first primary color has less of an effect on perceived resolution than the second primary color. In some embodiments, the first primary color is blue.

In some embodiments, the shared elongated subpixel is driven with data for the first primary color associated with a first color for display by the pixel and data for the first primary color associated with a second color for display by the adjacent pixel. In some embodiments, the shared elongated subpixel is driven by a first subpixel circuit associated with the pixel with data for the first primary color associated with a first color for display by the pixel and is driven by a second subpixel circuit associated with the adjacent pixel with data for the first primary color associated with a second color for display by the adjacent pixel.

According to another aspect there is provided a pixel pattern of material light emissive areas for an emissive display system having pixels, each pixel having subpixels, each subpixel having a light emitting device defining the material light emissive area of the subpixel, the pixels of the pixel pattern arranged into pixel pairs, the pixel pattern comprising: for each pixel pair, a first pixel, and a second pixel adjacent the first pixel, each first pixel comprising a shared elongated subpixel of a first primary color shared with the second pixel, and an elongated subpixel of a second or third primary color located in an area on an opposite side of the shared elongated subpixel from the second pixel, and each second pixel comprising the shared elongated subpixel shared with the first pixel, and an elongated subpixel of a third or second primary color different from the second or third primary color of the elongated subpixel of the first pixel located in an area on an opposite side of the shared elongated subpixel from the first pixel.

In some embodiments, the pixel pairs are arranged in rows and columns, and adjacent columns or rows of pixel pairs possess alternating arrangement of second and third primary colors among the subpixels of the pixels. In some embodiments, adjacent pixels possess alternating arrangement of second and third primary colors among the subpixels of the pixels.

In some embodiments, the shared elongated subpixel of each pixel pair has a length greater than half of a length or width of a pixel. In some embodiments, the shared elongated subpixel of each pixel pair has a length extending substantially to the length or width of the pixel.

In some embodiments, the pixel pattern further comprises, for each pixel of each pixel pair, at least one further subpixel of a the third or second primary color different from the second or third primary color of the elongated subpixel of the pixel.

In some embodiments, the first primary color has less of an effect on perceived resolution than the second and third primary colors.

In some embodiments, the shared elongated subpixel of each pixel pair is driven with data for the first primary color associated with a first color for display by the first pixel and data for the first primary color associated with a second color for display by second pixel. In some embodiments, the shared elongated subpixel of each pixel pair is driven by a first subpixel circuit associated with the first pixel with data for the first primary color associated with a first color for display by the first pixel and is driven by a second subpixel circuit associated with the second pixel with data for the first primary color associated with a second color for display by the second pixel.

The foregoing and additional aspects and embodiments of the present disclosure will be apparent to those of ordinary skill in the art in view of the detailed description of various embodiments and/or aspects, which is made with reference to the drawings, a brief description of which is provided next.

BRIEF DESCRIPTION OF THE DRAWINGS

The foregoing and other advantages of the disclosure will become apparent upon reading the following detailed description and upon reference to the drawings.

Figure 1A:
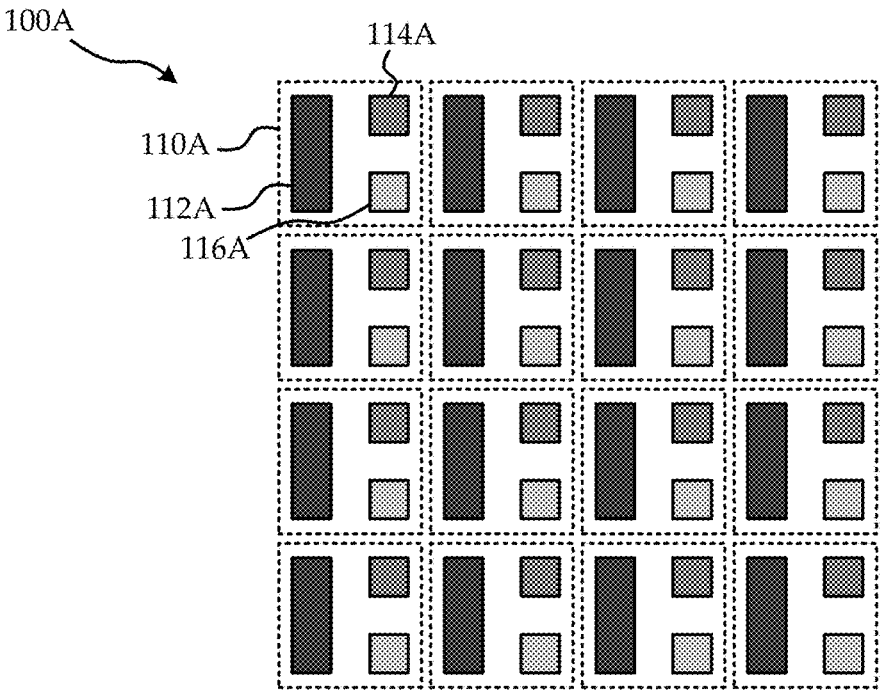
FIG. 1A (PRIOR ART)
FIG. 1A illustrates a known pixel pattern with one elongated subpixel per pixel.

While the present disclosure is susceptible to various modifications and alternative forms, specific embodiments or implementations have been shown by way of example in the drawings and will be described in detail herein. It should be understood, however, that the disclosure is not intended to be limited to the particular forms disclosed. Rather, the disclosure is to cover all modifications, equivalents, and alternatives falling within the spirit and scope of an invention as defined by the appended claims.

DETAILED DESCRIPTION

Pixel and subpixel patterns are important for today's high density visual display technologies. Performance metrics of such displays include pixels per inch (PPI) which specifies how many picture elements or pixels there are per inch of the display, and aperture ratio (also known as fill factor) which is the ratio of the material area capable of producing light for a given portion of the display to the total area of that portion of the display. As such, higher PPI and greater aperture ratios are desirable in any display and particularly for high density displays.

Pixel and subpixel patterns are created using a fabrication process, and like all fabrication processes pixel patterning has its own physical limitations. Generally speaking, color patterning for emissive devices is achieved through masking. Design rules of the masking process, however, impose constraints upon spacing between each pixel and subpixel pattern as well as the width or size of each pixel or subpixel pattern. The limitations due to the fabrication process are relatively coarse in the limit of modern high density visual displays, preventing increases in PPI and imposing small fill factors.

Figure 1B:
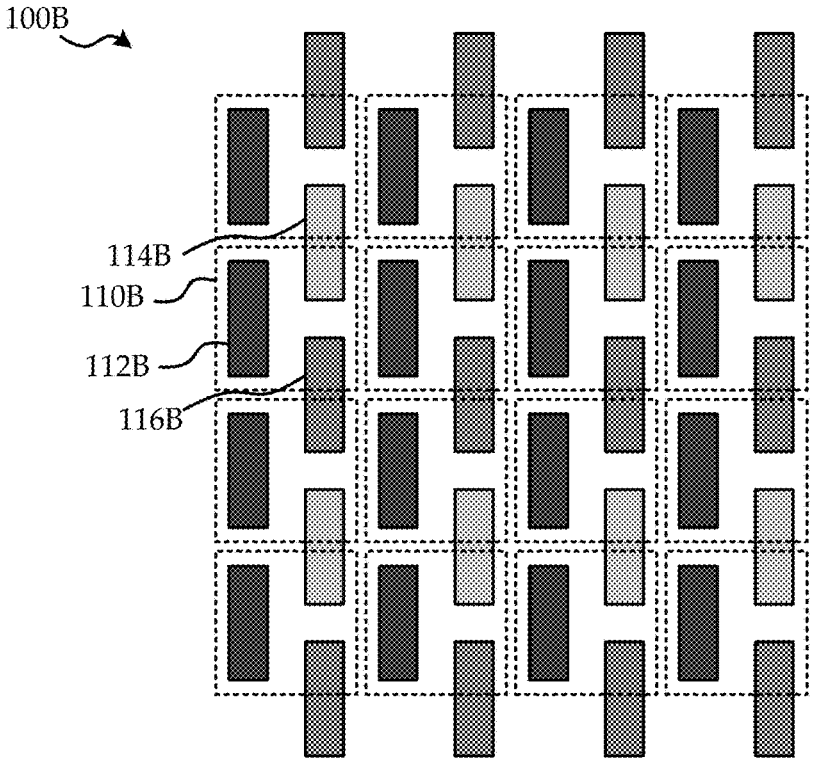
FIG. 1B (PRIOR ART)
FIG. 1B illustrates a known pixel pattern with elongated subpixels and in which each pixel shares two subpixels with adjacent pixels.

Referring to FIG. 1A and FIG. 1B, known pixel patterns 100A, 100B attempt to obtain higher PPI and greater fill factors but have drawbacks. The pixel pattern 100A of FIG. 1A includes an array of pixels arranged in rows and columns. Each pixel 110A comprises three subpixels which define the light emitting material areas of the pixel and include, an elongated subpixel 112A of a first primary color, a second subpixel 114A of a second primary color, and a third subpixel 116A of a third primary color. All of the pixels 100A are substantially similar to each other throughout the display. The elongated subpixel 112A has a width corresponding generally to the size of the other subpixels 114A, 116A, but is longer in one dimension, having a length extending along most of the length of a pixel 110A. This pixel pattern 100A, however, is not efficient at a very high PPI. The pixel pattern 100B of FIG. 1B also includes an array of pixels arranged in rows and columns. Each pixel 110B comprises three subpixels, a first elongated subpixel 112B of a first primary color, a second elongated subpixel 114B of a second primary color, and a third elongated subpixel 116B of a third primary color. All of the elongated subpixels 112B, 114B, 116B have similar widths and similar lengths. Each is longer in one dimension, having a length extending for a distance equal to most of the length of the pixel 110B. In this pixel pattern 100B, each pixel shares two elongated subpixels 114B 116B with adjacent pixels, an elongated subpixel 114B of one color (for example green) with one adjacent pixel and an elongated subpixel 116B of a second color (for example red) with another adjacent pixel.

Each pixel has substantially the same number, shape and size of subpixels, i.e. the geometry of the various subpixels arranged in each pixel is the same for all pixels. Each column has the same primary color arrangement of subpixels as all other columns, but adjacent rows of pixels possess alternating arrangement of red and green subpixels. This pixel pattern 100B, however, due to each pixel sharing two subpixels with adjacent pixels, specifically red and green, exhibits too great a loss of resolution.

While the embodiments described herein will be in the context of high density AMOLED displays it should be understood that the pixel and subpixel patterns described herein are applicable to any other display comprising pixels each having a plurality of subpixels, which are normally limited by methods of fabrication similar to masking.

It should be understood that the embodiments described herein pertain to pixel and subpixel patterns and do not limit the display technology underlying their operation and the operation of the displays in which they are implemented. The pixel and subpixel patterns described herein are applicable to any number of various types and implementations of various visual display technologies Patents which describe innovative technologies in relation to high resolution AMOLED displays include U.S. Pat. Nos. 8,552,636, 8,803,417, and 9,059,117, each entitled "High Resolution Pixel Architecture" and granted to Chaji et al.

Figure 2:
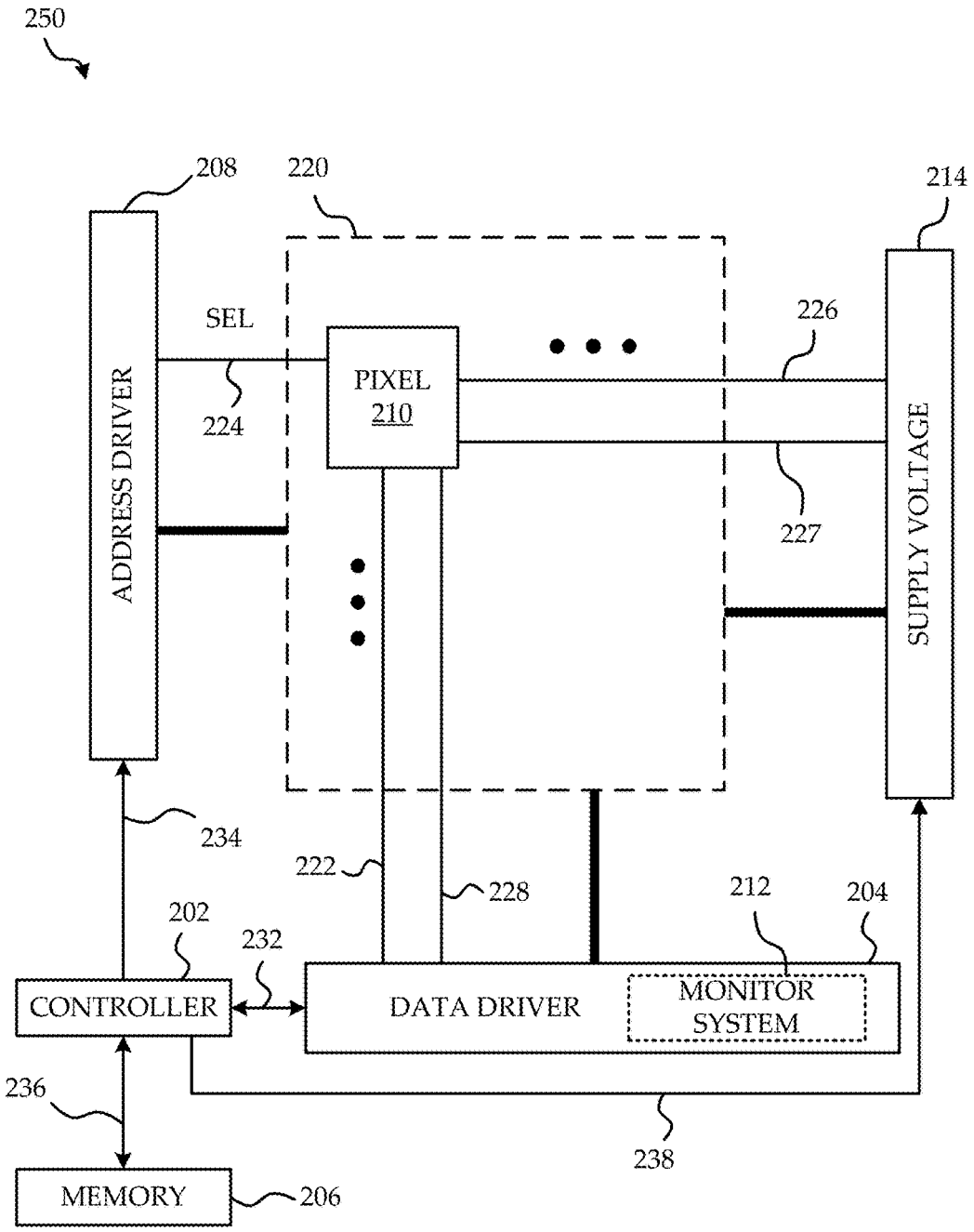
FIG. 2 illustrates an example display system in which pixels of the disclosed pixel and subpixel patterns are utilized.

FIG. 2 is a diagram of an example display system 250 utilizing the pixel patterns described further below. The display system 250 includes a display panel 220, an address driver 208, a data driver 204, a controller 202, and a memory storage 206.

The display panel 220 includes an array of pixels 210 (only one explicitly shown) arranged in rows and columns. Each of the pixels 210 is individually programmable to emit light with individually programmable luminance values. The controller 202 receives digital data indicative of information to be displayed on the display panel 220. The controller 202 sends signals 232 to the data driver 204 and scheduling signals 234 to the address driver 208 to drive the pixels 210 in the display panel 220 to display the information indicated. The plurality of pixels 210 of the display panel 220 thus comprise a display array or display screen adapted to dynamically display information according to the input digital data received by the controller 202. The display screen can display images and streams of video information from data received by the controller 202. The supply voltage 214 provides a constant power voltage or can serve as an adjustable voltage supply that is controlled by signals from the controller 202. The display system 250 can also incorporate features from a current source or sink (not shown) to provide biasing currents to the pixels 210 in the display panel 220 to thereby decrease programming time for the pixels 210.

For illustrative purposes, only one pixel 210 is explicitly shown in the display system 250 in FIG. 2. It is understood that the display system 250 is implemented with a display screen that includes an array of a plurality of pixels, such as the pixel 210, and that the display screen is not limited to a particular number of rows and columns of pixels. For example, the display system 250 can be implemented with a display screen with a number of rows and columns of pixels commonly available in displays for mobile devices, monitor-based devices, and/or projection-devices. In a multichannel or color display, a number of different types of pixels, each responsible for reproducing color of a particular channel or color such as red, green, blue, or white will be present in the display. Pixels of this kind may also be referred to as "subpixels" as a group of them collectively provide a desired color at a particular row and column of the display, which group of subpixels may collectively also be referred to as a "pixel".

The subpixels of the pixel 210 are operated by a driving circuit or pixel circuit that generally includes a driving transistor and a light emitting device. The light emitting device can optionally be an organic light emitting diode, having a shape and size defining the material area from which light of the subpixel is produced, but implementations of the present disclosure apply to pixel circuits having other electroluminescence devices, including current-driven light emitting devices and others. The driving transistor in the pixel 210 can optionally be an n-type or p-type amorphous silicon thin-film transistor, but implementations of the present disclosure are not limited to pixel circuits having a particular polarity of transistor or only to pixel circuits having thin-film transistors. The pixel circuit 210 can also include a storage capacitor for storing programming information and allowing the pixel circuit 210 to drive the light emitting device after being addressed. Thus, the display panel 220 can be an active matrix display array.

As illustrated in FIG. 2, the pixel 210 illustrated as the top-left pixel in the display panel 220 is coupled to a select lines 224, a supply line 226, a data lines 222, and a monitor line 228. A read line may also be included for controlling connections to the monitor line. In one implementation, the supply voltage 214 can also provide a second supply line to the pixel 210. For example, each pixel can be coupled to a first supply line 226 charged with Vdd and a second supply line 227 coupled with Vss, and the pixel circuits 210 can be situated between the first and second supply lines to facilitate driving current between the two supply lines during an emission phase of the pixel circuit. It is to be understood that each of the pixels 210 in the pixel array of the display 220 is coupled to appropriate select lines, supply lines, data lines, and monitor lines. It is noted that aspects of the present disclosure apply to pixels having additional connections, such as connections to additional select lines, and to pixels having fewer connections.

With reference to the pixel 210 of the display panel 220, the select lines 224 is provided by the address driver 208, and can be utilized to enable, for example, a programming operation of the pixel 210 by activating a switch or transistor to allow the data lines 222 to program the various subpixels of the pixel 210. The data lines 222 convey programming information from the data driver 204 to the pixel 210. For example, the data lines 222 can be utilized to apply programming voltages or programming current to the subpixels of the pixel 210 in order to program the subpixels of the pixel 210 to emit a desired amount of luminance. The programming voltages (or programming current) supplied by the data driver 204 via the data lines 222 are voltages (or currents) appropriate to cause the subpixels of the pixel 210 to emit light with a desired amount of luminance according to the digital data received by the controller 202. The programming voltages (or programming currents) can be applied to the subpixels of the pixel 210 during a programming operation of the pixel 210 so as to charge storage devices within the subpixels of the pixel 210, such as a storage capacitor, thereby enabling the subpixels of the pixel 210 to emit light with the desired amount of luminance during an emission operation following the programming operation. For example, the storage device in a subpixel of the pixel 210 can be charged during a programming operation to apply a voltage to one or more of a gate or a source terminal of the driving transistor during the emission operation, thereby causing the driving transistor to convey the driving current through the light emitting device according to the voltage stored on the storage device.

Generally, in each subpixel of the pixel 210, the driving current that is conveyed through the light emitting device by the driving transistor during the emission operation of the pixel 210 is a current that is supplied by the first supply line 226 and is drained to a second supply line 227. The first supply line 226 and the second supply line 227 are coupled to the voltage supply 214. The first supply line 226 can provide a positive supply voltage (e.g., the voltage commonly referred to in circuit design as "Vdd") and the second supply line 227 can provide a negative supply voltage (e.g., the voltage commonly referred to in circuit design as "Vss"). Implementations of the present disclosure can be realized where one or the other of the supply lines (e.g., the supply line 227) is fixed at a ground voltage or at another reference voltage.

The display system 250 also includes a monitoring system 212. With reference again to the pixel 210 of the display panel 220, the monitor line 228 connects the pixel 210 to the monitoring system 212. The monitoring system 212 can be integrated with the data driver 204, or can be a separate stand-alone system. In particular, the monitoring system 212 can optionally be implemented by monitoring the current and/or voltage of the data line 222 during a monitoring operation of the pixel 210, and the separate monitor line 228 can be entirely omitted.

Figure 3:
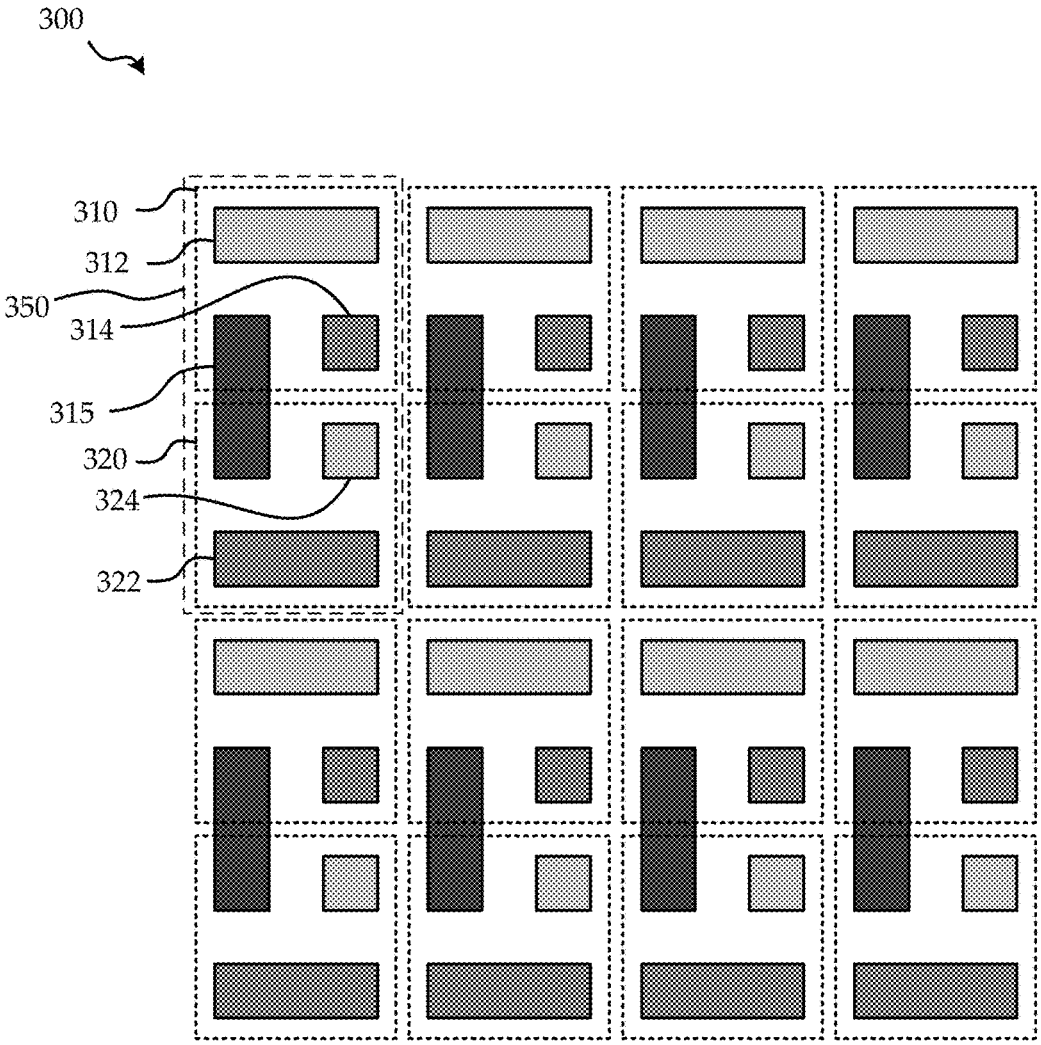
FIG. 3 illustrates a pixel pattern in which each pixel shares one elongated subpixel with an adjacent pixel.

Referring to FIG. 3, a pixel pattern 300 according to an embodiment will now be described. The pixel pattern 300 includes an array of pixels arranged in rows and columns and grouped in pairs. Each pixel pair 350 comprises a first pixel 310 and a second pixel 320 adjacent to one another. Each first pixel 310 of each pixel pair 350 comprises three subpixels, a shared elongated subpixel 315 of a first primary color which is shared with the second pixel 320 of the pixel pair 350, an elongated subpixel 312 of a second primary color, and a further subpixel 314 of a third primary color. Each second pixel 320 of each pixel pair 350 comprises three subpixels, the shared elongated subpixel 315 which is shared with the first pixel 310 of the pixel pair 350, an elongated subpixel 322 of the third primary color, and a further subpixel 324 of the second primary color. All of the elongated subpixels 315, 312, 322 have similar widths and similar lengths. Each is longer in one dimension, having a length extending for a distance equal to most of the length (or width) of a pixel 310, 320 (greater than half) and possibly extending to a length substantially the same as the length (or width) of the pixel 310, 320. The shared elongated subpixel 315 of each pixel pair 350 is oriented perpendicularly to a line bisecting the pixel pair 350 between the first and second pixels 310, 320. The elongated subpixels 312 322 of the first and second pixels 310, 320 are oriented perpendicularly to the orientation of the shared elongated subpixel 315, and each is located within its respective pixel 310, 320 closer to the edge of that pixel which is farthest away from the adjacent, other pixel 320, 310 of the pixel pair 350. In this pixel pattern 300, each pixel 310, 320 shares only one shared elongated subpixel 315 with the other adjacent pixel 320, 310 of the pixel pair 350. The first pixel 310 and the second pixel 320 of the pixel pair 350 are, geometrically speaking, mirror images of each other in a line bisecting the pixel pair 350 between the first pixel 310 and the second pixel 320 of the pixel pair 350. Each pixel pair 350 has substantially the same number, shape and size of subpixels, i.e., the geometry of the various subpixels and pixels arranged in each pixel pair is the same for all pixel pairs, and each pixel pair has the same primary color arrangement of subpixels as all other pixel pairs.

For some embodiments, in each pixel pair 350 of the pixel pattern 300, the first primary color, or the primary color of the shared elongated subpixel 315 is blue which has relatively less of an effect on perceived resolution, and may be any other color which has relatively less of an effect on perceived resolution. In some embodiments, such a shared elongated subpixel 315 may be driven by one subpixel circuit or two separate subpixel circuits. In the case of a single subpixel circuit, data for the first primary color associated with the color for display by the first pixel 310 and data for the first primary color associated with the color for display by the second pixel 320 are both used to drive the brightness of the shared subpixel 315. In the case of two separate subpixel circuits driving the shared elongated subpixel 315, the data for the first primary color associated with the color for display by the first pixel 310 is utilized by a first subpixel circuit to drive the shared elongated subpixel 315 while data for the first primary color associated with the color for display by the second pixel 320 is utilized by a second subpixel circuit to drive the shared elongated subpixel 315. In the case of the shared elongated subpixel's 315 being driven by two separate subpixel circuits, the resolution loss is significantly minimized.

The pixel pattern 300, having greater pattern area per unit area of the display results in a higher fill factor, or aperture ratio than similarly sized (i.e., of similar PPI) patterns such as those illustrated in FIG. 1A and FIG. 1B. Differences between pixels in the size and shape of the pattern for each color, such as for example, the elongated subpixel 412 of the first pixel 450 is larger than the further subpixel 424 of the second subpixel 420 but has the same primary color, may cause some visual artifacts. Driving each pixel differently to account for these differences can be used to correct for these visual artifacts.

Figure 4:
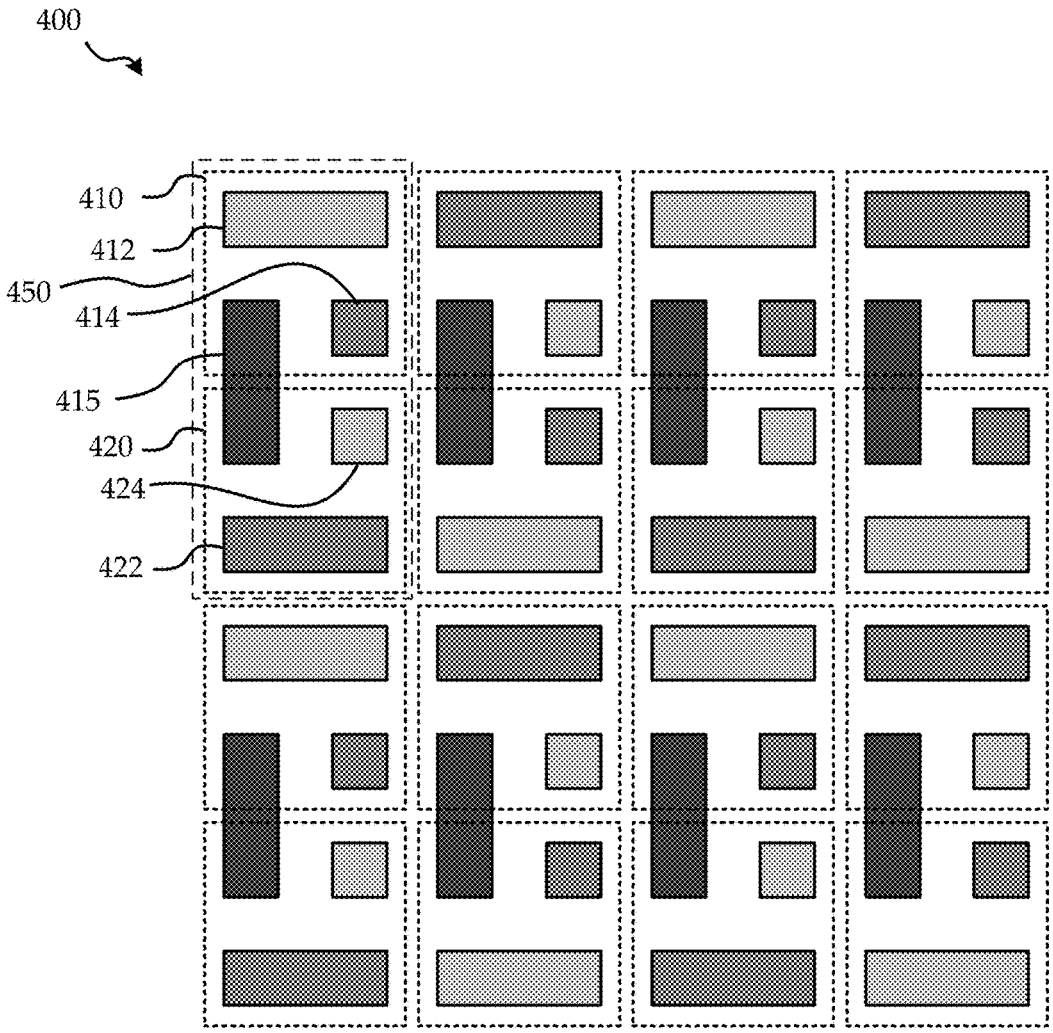
FIG. 4 illustrates a pixel pattern in which each pixel shares one elongated subpixel with an adjacent pixel and for which neighboring pixels have alternating subpixel color patterns.

Referring to FIG. 4, a pixel pattern 400 according to an embodiment will now be described. This pixel pattern is less susceptible to the visual artifacts due to differences between pixels in the size and shape of the pattern for each color as described above. The pixel pattern 400 includes an array of pixels arranged in rows and columns and grouped in pairs. Each pixel pair 450 comprises a first pixel 410 and a second pixel 420 adjacent to one another. Each first pixel 410 of each pixel pair 450 comprises three subpixels, a shared elongated subpixel 415 of a first primary color which is shared with the second pixel 420 of the pixel pair 450, an elongated subpixel 412, and a further subpixel 414. Each second pixel 420 of each pixel pair 450 comprises three subpixels, the shared elongated subpixel 415 which is shared with the first pixel 410 of the pixel pair 450, an elongated subpixel 422, and a further subpixel 424. All of the elongated subpixels 415, 412, 422 have similar widths and similar lengths. Each is longer in one dimension, having a length extending for a distance equal to most of the length (or width) of a pixel 410, 420 (greater than half) and possibly extending to a length substantially the same as the length (or width) of the pixel 410, 420. The shared elongated subpixel 415 of each pixel pair 450 is oriented perpendicularly to a line bisecting the pixel pair 450 between the first and second pixels 410, 420. The elongated subpixels 412 422 of the first and second pixels 410, 420 are oriented perpendicularly to the orientation of the shared elongated subpixel 415, and each is located within its respective pixel 410, 420 closer to the edge of that pixel which is farthest away from the adjacent, other pixel 420, 410 of the pixel pair 450. In this pixel pattern 400, each pixel 410, 420 shares only one shared elongated subpixel 415 with the other adjacent pixel 420, 410 of the pixel pair 450. The first pixel 410 and the second pixel 420 of the pixel pair 450 are, geometrically speaking, mirror images of each other in the line bisecting the pixel pair 450 between the first pixel 410 and the second pixel 420 of the pixel pair 450.

In each pixel pair 450, the elongated subpixel 412 of the first pixel 410 and the further subpixel 424 of the second pixel 420 are the same color which is one of the second and the third primary color, while the elongated subpixel 422 of the second pixel 420 and the further subpixel 414 of the first pixel 410 are the same color which is the other of the second and the third primary color.

Each pixel pair 450 has substantially the same number, shape and size of subpixels, i.e. the geometry of the various subpixels and pixels arranged in each pixel pair is the same for all pixel pairs. Each row of pixel pairs have the same primary color arrangement of subpixels and pixels as all other rows of pixel pairs, but adjacent columns of pixel pairs possess alternating arrangement of second and third primary colors among the subpixels. Equivalently, adjacent pixels possess alternating arrangement of second and third primary colors among the subpixels. The alternation of the second and third primary colors in adjacent columns of pixel pairs reduces visual artifacts due to the differences in shape and size of the pattern for each color as described above.

For some embodiments, in each pixel pair 450 of the pixel pattern 400, the first primary color, or the primary color of the shared elongated subpixel 415 is blue which has relatively less of an effect on perceived resolution, and may be any other color which has relatively less of an effect on perceived resolution. In some embodiments, such a shared elongated subpixel 415 may be driven by one subpixel circuit or two separate subpixel circuits. In the case of a single subpixel circuit, data for the first primary color associated with the color for display by the first pixel 410 and data for the first primary color associated with the color for display by the second pixel 420 are both used to drive the brightness of the shared subpixel 415. In the case of two separate subpixel circuits driving the shared elongated subpixel 415, the data for the first primary color associated with the color for display by the first pixel 410 is utilized by a first subpixel circuit to drive the shared elongated subpixel 415 while data for the first primary color associated with the color for display by the second pixel 420 is utilized by a second subpixel circuit to drive the shared elongated subpixel 415. In the case of the shared elongated subpixel's 415 being driven by two separate subpixel circuits, the resolution loss is significantly minimized.

The pixel pattern 400, having greater pattern area per unit area of the display results in a higher fill factor, or aperture ratio than similarly sized (i.e., of similar PPI) patterns such as those illustrated in FIG. 1A and FIG. 1B.

It should be understood that although the above makes reference to pixels and pixel pairs of the pixel patterns being arranged in "rows" and "columns", these terms are interchangeable with regard to the orientation and configuration of each of the repeating patterns described above. Although the above makes reference to a pixel's "width" and "length" it is understood that these terms are interchangeable.

While particular implementations and applications of the present disclosure have been illustrated and described, it is to be understood that the present disclosure is not limited to the precise construction and compositions disclosed herein and that various modifications, changes, and variations can be apparent from the foregoing descriptions without departing from the spirit and scope of an invention as defined in the appended claims.

What is claimed is:

1. A pixel pattern of material light emissive areas for an emissive display system having pixels, each pixel having subpixels, each subpixel having a light emitting device defining the material light emissive area of the subpixel, the pixel pattern comprising: for each pixel, a shared elongated subpixel of a first primary color shared with an adjacent pixel and an elongated subpixel of a second or third primary color located in an area on an opposite side of the shared elongated subpixel from the adjacent pixel, wherein the shared elongated subpixel is driven with data for the first primary color associated with a first color for display by the pixel, and wherein the shared alongated subpixel is driven with data for the first primary color associated with a second color for display by the adjacent pixel.

2. The pixel pattern of claim 1, wherein the shared elongated subpixel has a length greater than half of a length or width of a pixel.

3. The pixel pattern of claim 2, wherein the shared elongated subpixel has a length extending substantially to the length or width of the pixel.

4. The pixel pattern of claim 1, wherein the pixel pattern further comprises, for each pixel, at least one further subpixel of a the third or second primary color different from the second or third primary color of the elongated subpixel.

5. The pixel pattern of claim 1, wherein the first primary color has less of an effect on perceived resolution than the second primary color.

6. The pixel pattern of claim 5, wherein the first primary color is blue.

7. The pixel pattern of claim 1, wherein the shared elongated subpixel is driven by a first subpixel circuit associated with the pixel with data for the first primary color associated with a first color for display by the pixel and is driven by a second subpixel circuit associated with the adjacent pixel with data for the first primary color associated with a second color for display by the adjacent pixel.

8. A pixel pattern of material light emissive areas for an emissive display system having pixels, each pixel having subpixels, each subpixel having a light emitting device defining the material light emissive area of the subpixel, the pixels of the pixel pattern arranged into pixel pairs, the pixel pattern comprising:

for each pixel pair, a first pixel, and a second pixel adjacent the first pixel, each first pixel comprising a shared elongated subpixel of a first primary color shared with the second pixel, and an elongated subpixel of a second or third primary color located in an area on an opposite side of the shared elongated subpixel from the second pixel, and each second pixel comprising the shared elongated subpixel shared with the first pixel, and an elongated subpixel of a third or second primary color different from the second or third primary color of the elongated subpixel of the first pixel located in an area on an opposite side of the shared elongated subpixel from the first pixel.

9. The pixel pattern of claim 8, wherein the pixel pairs are arranged in rows and columns, and adjacent columns or rows of pixel pairs possess alternating arrangement of second and third primary colors among the subpixels of the pixels.

10. The pixel pattern of claim 8, wherein adjacent pixels possess alternating arrangement of second and third primary colors among the subpixels of the pixels.

11. The pixel pattern of claim 8, wherein the shared elongated subpixel of each pixel pair has a length greater than half of a length or width of a pixel.

12. The pixel pattern of claim 11, wherein the shared elongated subpixel of each pixel pair has a length extending substantially to the length or width of the pixel.

13. The pixel pattern of claim 8, wherein the pixel pattern further comprises, for each pixel of each pixel pair, at least one further subpixel of a the third or second primary color different from the second or third primary color of the elongated subpixel of the pixel.

14. The pixel pattern of claim 8, wherein the first primary color has less of an effect on perceived resolution than the second and third primary colors.

15. The pixel pattern of claim 14, wherein the first primary color is blue.

16. The pixel pattern of claim 8, wherein the shared elongated subpixel of each pixel pair is driven with data for the first primary color associated with a first color for display by the first pixel and data for the first primary color associated with a second color for display by second pixel.

17. The pixel pattern of claim 16, wherein the shared elongated subpixel of each pixel pair is driven by a first subpixel circuit associated with the first pixel with data for the first primary color associated with a first color for display by the first pixel and is driven by a second subpixel circuit associated with the second pixel with data for the first primary color associated with a second color for display by the second pixel.

* * * * *